US005205649A

United States Patent [19]

Fullerton

[11] Patent Number: 5,205,649

[45] Date of Patent: Apr. 27, 1993

[54] LEAKPROOF PACKAGING

[75] Inventor: Murray G. Fullerton, Redmond, Wash.

[73] Assignee: Trigon Packaging Corporation, Redmond, Wash.

[21] Appl. No.: 612,213

[22] Filed: Nov. 9, 1990

Related U.S. Application Data

[63] Continuation-in-part of Ser. No. 575,064, Aug. 29, 1990.

[51] Int. Cl.[5] ..... B65D 33/18; B65D 33/34

[52] U.S. Cl. ..... 383/5; 383/78; 383/108

[58] Field of Search ..... 383/5, 78, 61, 108, 383/906, 84, 63, 81, 86, 66, 82, 83, 85, 93, 107, 108

[56] References Cited

U.S. PATENT DOCUMENTS

| | | | |
|---|---|---|---|
| 2,635,788 | 4/1953 | Snyder et al. | 383/81 X |
| 2,819,010 | 1/1958 | Amiguet . | |
| 3,070,280 | 12/1962 | Richmond . | |
| 3,154,239 | 10/1964 | Madsen | 383/81 |
| 3,279,331 | 10/1966 | Platt | 383/86 X |
| 3,310,225 | 3/1967 | Hoblit et al. . | |
| 3,372,861 | 3/1968 | Johnson et al. . | |
| 3,613,874 | 10/1971 | Miller . | |
| 4,348,440 | 9/1982 | Kriozere . | |
| 4,580,683 | 4/1986 | Gochenour . | |
| 4,759,643 | 7/1988 | Canno . | |
| 4,785,940 | 11/1988 | Wilson . | |
| 4,824,261 | 4/1989 | Provost | 383/61 X |
| 4,848,928 | 7/1989 | Ausnit | 383/61 X |
| 4,941,196 | 7/1990 | Edelman et al. | 383/5 |
| 4,955,981 | 9/1990 | Provost | 383/86 |
| 4,978,055 | 12/1990 | Miller | 383/107 X |
| 5,056,930 | 10/1991 | Mestetsky | 383/5 |

FOREIGN PATENT DOCUMENTS

| | | | |
|---|---|---|---|
| 0345930 | 12/1989 | European Pat. Off. | 383/61 |
| 0393841 | 10/1990 | European Pat. Off. | 383/5 |
| 812381 | 4/1959 | United Kingdom | 383/78 |
| 1470786 | 4/1977 | United Kingdom | 383/84 |
| 1536784 | 12/1978 | United Kingdom | 383/78 |
| 2051003 | 1/1981 | United Kingdom | 383/5 |
| 2145997 | 4/1985 | United Kingdom | 383/5 |
| 2193484 | 2/1988 | United Kingdom | 383/78 |

*Primary Examiner*—Allan N. Shoap
*Assistant Examiner*—Jes F. Pascua
*Attorney, Agent, or Firm*—Christensen, O'Connor, Johnson & Kindness

[57] ABSTRACT

Liquidtight containers which are so integrated at the upper ends thereof as to keep fluids from escaping through the gaps between the front and back walls of the container. The closure system of the bag is designed to surround the upper end of the bag with adhesive when the bag is sealed so that fluid cannot escape between the main part of the bag and the closure. The closure system can also be designed so that an attempt to open the bag and then reseal it will be readily evident.

7 Claims, 2 Drawing Sheets

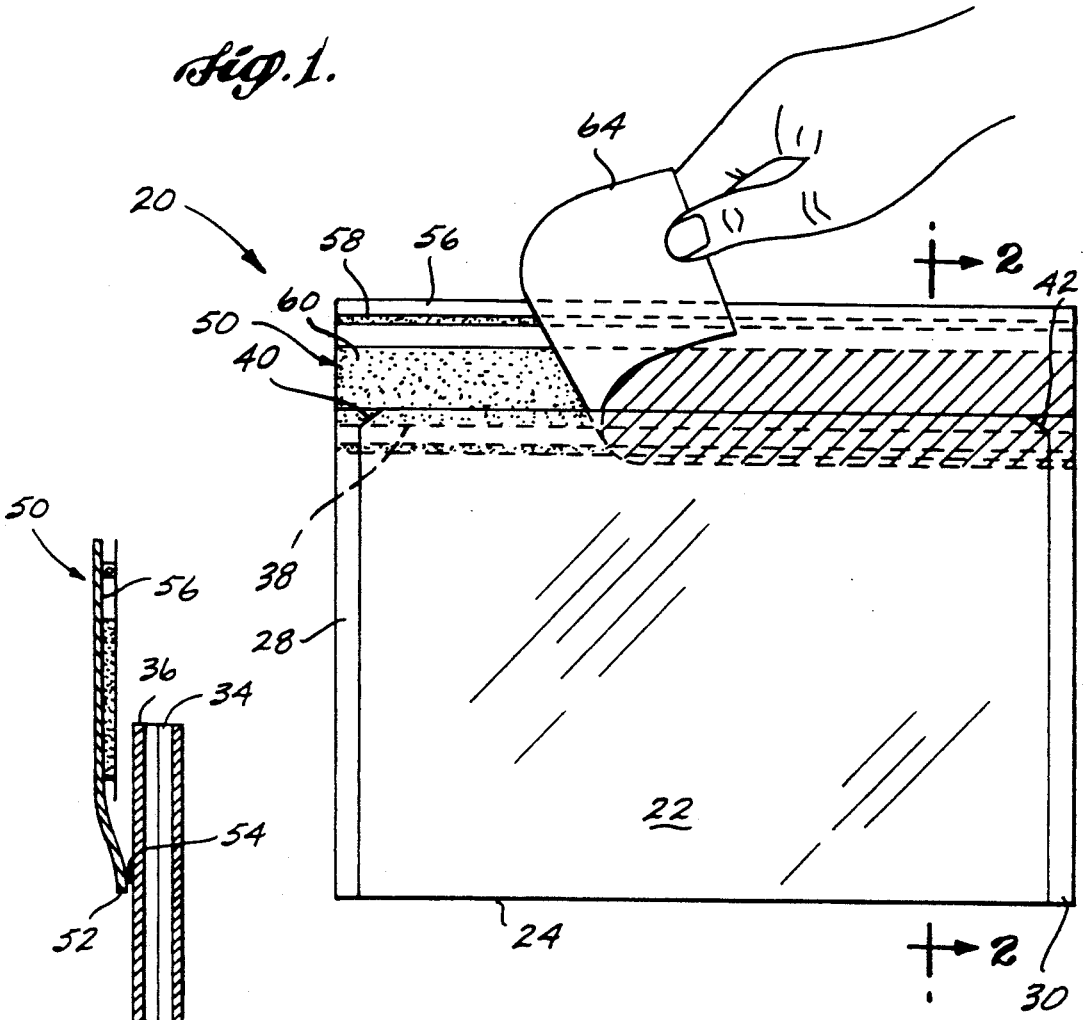
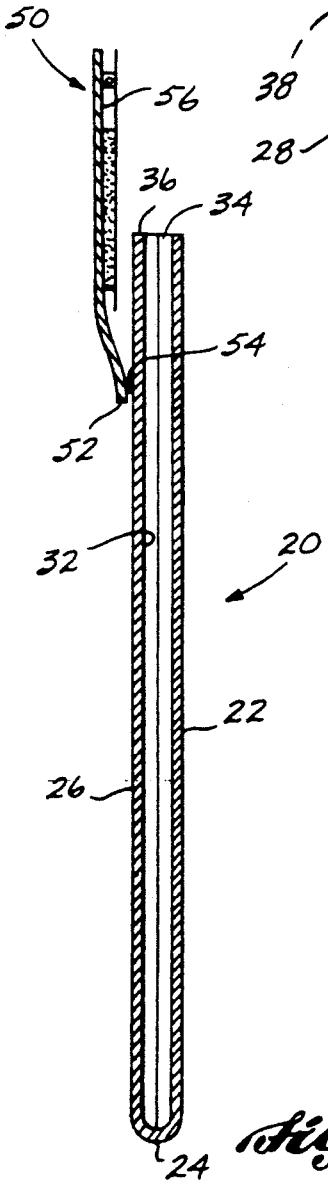
Fig. 2.
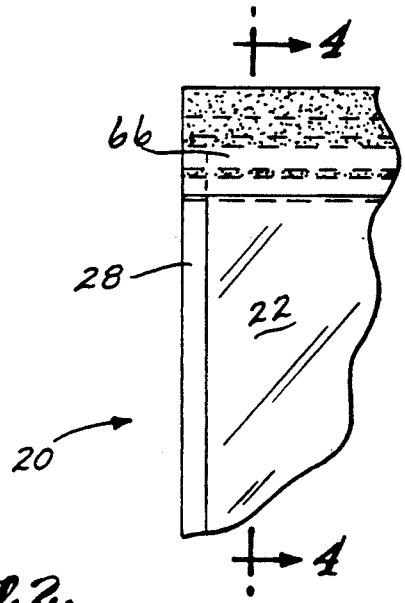
Fig. 3.
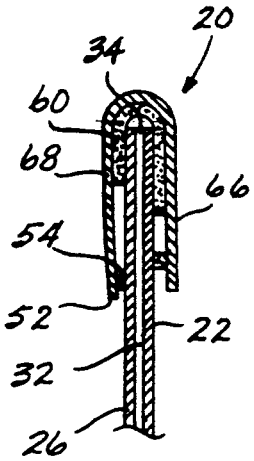
Fig. 4.

LEAKPROOF PACKAGING

RELATION TO OTHER APPLICATION

The present application is a continuation-in-part of application Ser. No. 07/575,064 filed Aug. 29, 1990 by Murray G. Fullerton for BAGS WITH SEPARATE COMPARTMENTS. The benefit of the filing date of the prior application is hereby claimed under 35 U.S.C. §120.

TECHNICAL FIELD OF THE INVENTION

The present invention relates to novel, fluid-tight, improved packages in which human and animal body fluids, other fluids, and contents which are in part fluid can be safely shipped, otherwise transferred from one location to another, and stored.

BACKGROUND OF THE INVENTION

Many bags, envelope-, and pouch-type packages are disclosed in the patent literature. Those patented packages thought to most closely resemble the novel, leakproof containers disclosed herein are illustrated and described in the following United States patents.

| U.S. Pat. No. | Patentee(s) | Issue Date |
|---|---|---|
| 2,819,010 | Amiguet | 07 Jan. 1958 |
| 3,070,280 | Richmond | 25 Dec. 1962 |
| 3,310,225 | Hoblit et al. | 21 Mar. 1967 |
| 3,372,861 | Johnson et al. | 12 Mar. 1968 |
| 3,613,874 | Miller | 19 Oct. 1971 |
| 4,348,440 | Kriozere | 07 Sep. 1982 |
| 4,580,683 | Gochenour | 08 Apr. 1986 |
| 4,759,643 | Canno | 26 July 1988 |
| 4,785,940 | Wilson | 22 Nov. 1988 |

Packaging or containers of the type with which the present invention is concerned have front and back walls sealed together or otherwise integrated at the sides and bottom of the container and a flap for closing the remaining, open end of the container. This flap is typically an integral part of the container rear wall or bonded at one edge to that wall. Once the wanted contents have been loaded into the container, the flap is folded down over the open end of the container to close that end and bonded to the container's front wall.

For the container to not leak, the seal or seam between the back and front walls of the container must have total integrity over the entire length of the container. While a seal of that character can easily be realized in the more central positions of the container, this goal is difficult to reach those ends of the side margins of the container at its open end. Consequently, fluids—albeit in small or even minute quantities—may escape at their marginal edges from the interiors of bags in which fluids have heretofore been transported or stored. Because these fluids may be contaminated with deadly toxins, viruses, etc., even minute leakage of the fluid is unacceptable.

Because their contents may be dangerous, it is often imperative that the closure of a container employed to transport or store fluids be tamper evidencing. This means that attempts to open and then reseal the container must be made readily apparent.

Of those patents cited above, only Amiguet (U.S. Pat. No. 2,819,010) appears to be concerned with the problem of leakage of a fluid from the interior of a container to the surrounding environment. However, the Amiguet closure system does not address the problem of increased susceptibility to leakage at the edges of the bag; and, at those locations, his closure-to-container seal is structurally conventional and would be no more resistant to leakage than a conventional one.

As is made apparent in parent patent application Ser. No. 07/575,064, containers with tamper evidencing closure systems are not only known but are widely used in applications involving the transfer of currency, stock certificates, bearer bonds, and other valuable items. However, no one has heretofore to my knowledge addressed the problem of furnishing a system which is capable of both providing an absolutely liquidtight seal and evidence of tampering.

SUMMARY OF THE INVENTION

Disclosed herein are containers of the bag or pouch type which are specifically designed for the transporting and storage of fluids and material things having fluids associated with them.

These bags are typically made from a folded piece of an impervious polymer such as a polyethylene. The fold provides back and front walls which are sealed together to form continuous seams extending from the closed lower of the bag to its open upper end at the side margins of the bag. Beginning at a level below the open upper end of the bag, these side seals are angled inwardly (i.e., toward the other side seal). This minimizes the possibility that even minute quantities of fluid will leak from the bag through the side seals at their most vulnerable point —the upper end of the bag.

A closure extending from one side margin to the other is provided at the upper end of the bag. One lower marginal edge of the closure is integrated with one wall (back or front) of the bag, and the bag is sealed by folding the closure down over the open end of the bag and then bringing the depending part of the closure into sealing engagement with the other wall of the bag over the complete width of the bag. Adhesive between the bag's main component and the closure over a wide enough band as to provide adhesive contact between the closure and both sides of the bag minimizes the chances of fluids leaking from the sealed bag between the closure and the main bag component.

Parameters such as the adhesive employed to seal the bag and the materials from which the closure and main body component are fabricated may be so chosen that the separation of the closure from the bag wall to which it is sealed will leave part of the adhesive behind and distort the material from which the main bag component and/or closure are fabricated. This makes it at least very difficult to reseal the bag without the separation of the closure from the wall and the reattachment of the closure to that wall being made clearly evident.

Bags as just described can be made economically and in large quantities at high speed on a production line also described herein.

OBJECTS OF THE INVENTION

From the foregoing, it will be apparent to the reader that one important and primary object of the invention resides in the provision of novel, improved bags or containers for shipping and otherwise transporting human and animal fluids, other fluids, and material things such as animal and human specimens and body parts that may have fluids associated with them.

More specific but nevertheless important objects of the invention reside in the provision of bags as characterized in the preceding object:

which reduce to a minimum the possibility that fluid might escape from a bag after the bag is sealed;

which have a closure system that makes evident attempts to open and then reseal the bag; and which can be manufactured economically and in large quantities at high speed.

Other important objects and features and additional advantages of the invention will be apparent to the reader from the foregoing and the appended claims and as the ensuing detailed description and discussion proceeds in conjunction with the accompanying drawing.

BRIEF DESCRIPTION OF THE DRAWING

In the drawing:

FIG. 1 is a front view of a pouch which embodies the principles of the invention and has a release tape that is in the process of being removed so that the open, upper end of the bag can be closed or sealed;

FIG. 2 is a section through the open or unsealed bag, taken substantially along line 2—2 of FIG. 1;

FIG. 3 is a fragmentary front view of the bag after it has been closed and sealed;

FIG. 4 is a section through FIG. 3, taken substantially along line 4—4 of that FIGURE.

DETAILED DESCRIPTION OF THE INVENTION

Figure 5:
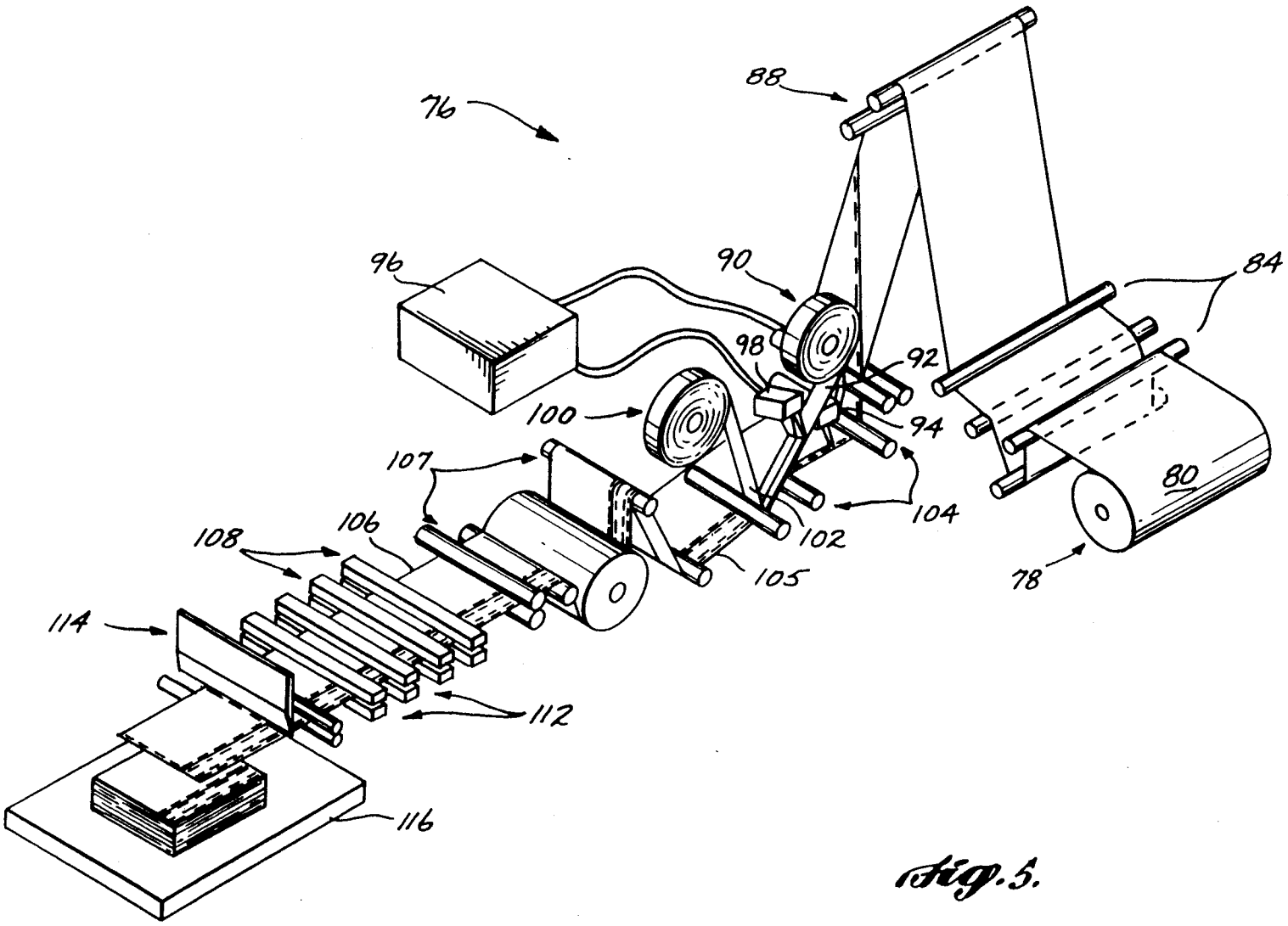
FIG. 5 is a schematic view of a production line on which bags such as that illustrated in FIG. 1 can be manufactured.

In the interest of conciseness and clarity, a number of orientation related terms such as front and back, below, top and bottom, etc. have and will hereinafter be employed in this text. Those terms are related to a bag with the orientation depicted in FIGS. 1–4 of the drawing; they are not intended to limit the scope of the invention as in part defined with them in the appended claims.

Referring now to the drawing, FIGS. 1–4 depict a bag 20 constructed in accord with, and embodying, the principles of the present invention.

Bag 20 has a front wall 22 folded or joined and sealed at the lower edge 24 of the bag to an integral back wall 26. Front and back walls 22 and 26 are also joined together at opposite edges of bag 20 by heat sealing or with another appropriate technique. The side seams or seals are identified in FIG. 1 by reference characters 28 and 30. The just-described edge sealing results in a bag with a pocket or compartment 32. As indicated by reference character 34, pocket 32 is open at the upper edge 36 of the bag 20. Compartment 32 is designed to contain fluids and any of a wide variety of artifacts having a fluid associated therewith.

As discussed above, it is often essential that a bag intended for the purposes just identified have total integrity; i.e., that it uncomprisingly preclude leakage. It was also pointed out that, in a bag of the construction just described, perhaps the greatest possibility of leakage is through the side seams 28 and 30 at the upper end of the bag.

In bags embodying the principles of the present invention, such as bag 20, this possibility of leakage through the side seams at the upper end of the bag is essentially eliminated by a novel construction of those seams. In particular, beginning at a level 38 spaced downwardly from the upper edge 36 of bag 30, and continuing to that edge, the width of the seals is expanded, making the seams wider over the span from level 38 to bag top end 36. In the particular bag 20 illustrated in the drawing, as one example, this increased seam width is provided by angling the facing inner edges 40 and 42 of the side seams 28 and 30 inwardly (i.e., toward each other), inner edges 40 and 42 continuing in this direction until the upper end 36 of the bag is reached. The result, as suggested above, is an increased width of seam which precludes leakage of fluid from the interior of bag 20 to the ambient surroundings through side seams 28 and 30 at the upper end of the bag.

It is also often important that attempts to access the interior of a bag with fluid contents be made evident. In bag 20 this objective is obtained with a tamper evidencing closure 48. This closure includes a panel or flap 50 which spans bag 20. At its lower edge 52, panel 50 is bonded to the back wall 26 of bag 20 as by the illustrated line 54 of hot melt adhesive or heat sealed to that panel.

On the front side 56 of closure panel 50 are two, spaced apart lines 58 and 60 of a pressure sensitive adhesive. Both lines of adhesive 58 and 60 extend continuously from edge to edge of bag 20 as is best shown in FIG. 1.

Overlying the two lines of pressure sensitive adhesive 58 and 60 is a protective release tape 64. The release tape also extends from one edge of bag 20 to the other edge thereof.

In use, items having fluids associated therewith which are to be transferred from one location to another, or perhaps securely stored, are placed in the pocket or compartment 32 of bag 20 through the open upper end 34 of that compartment. Then, release tape 64 is removed from tamper evidencing closure flap 50 as shown in FIG. 1. Next, the flap 50 is trained first over the upper edge 36 of bag 20 and then downwardly. This generates an integral, depending, flap portion 66 which is pressed against the front wall 22 of bag 20 (see FIGS. 3 and 4). With this done, front and rear walls 22 and 26 are clamped together at the upper edge 36 of bag 20 to securely and continuously close the opening 34 to compartment 32.

The wider band of adhesive 60 bonds the front and rear bag walls 22 and 26 to the depending flap portion 66 on the front side of bag 20 and to the integral, also depending flap portion 68 on the rear side of the bag. This generates a secure, continuous, fluidtight seal extending from edge-to-edge of the bag at the open end of pocket 32. The depending flap portion 66 on the front side of the bag is also bonded to the bag's front wall 22 by the second line 58 of pressure sensitive adhesive. This keeps the flap in place and from interfering with subsequent handling of the bag. It also contributes to the tamper evidencing capabilities of bag 20.

To remove the contents of bag compartment 32 after the bag is sealed, one must: (1) rupture the front wall 22 or rear wall 26 of bag 20, the lower edge 24 of the bag, or tamper evidencing closure flap 50; or (2) separate the depending segment 66 of tamper evidencing closure flap 50 from the front wall 22 of the bag. Attempts to do any of these without leaving evidence of the attempt would at best be extremely difficult. Slits in or other ruptures of the bag walls or closure flap 50 are readily evident. So are attempts to open and then reclose the tamper evidencing closure 48. Readily seen adhesive of strips 58 and 60 will be left behind on the front wall 22 of bag 20 when closure flap 50 is pulled away, and it is virtually impossible to reclose the bag in a manner which will precisely align that adhesive with the adhesive remaining on the front side 56 of closure flap 50. Furthermore, the materials of flap segment 66 and/or bag front wall 22 are distorted in the course of separating flap 66 from the bag wall. It is virtually impossible to conceal this distortion in resealing bag 20.

The components of bag 20 will typically be made from either a high density or low density, impervious polyethylene or a coextruded or combination of such polymers. Along with other factors, this keeps fluids from escaping through the front and back walls of the bag and the closure flap and allows the bags to be recovered and melted down and the polymer(s) repelletized and recycled.

Appropriate hot melt and pressure sensitive adhesives are available from a number of commercial sources, and any desired ones of those can be employed.

The front and back walls 22 and 26 of bag 20 can be opaque or wholly or partially transparent. For example, a transparent window might be left in the front wall 22 of bag 20 so that the contents of compartment 32 can be seen without opening the bag.

One exemplary production line on which bags 20 can be fabricated economically, and at high speed, is illustrated in FIG. 5 and identified by reference character 76. That line includes an unwind stand 78 with sheet stock 80 for front and back bag walls 22 and 26. From unwind stand 78, stock 80 runs over rolls collectively identified by reference character 84 to a center folder 118. This unit folds the bag wall-forming sheet 80 in half to generate what will subsequently become the front and rear walls 22 and 26 of bags 20.

Next in line are: (1) an unwind stand 90 for a strip 92 that is turned into tamper evidencing closure flaps 50; (2) an applicator 94 with a feed reservoir 96 for applying to sheet 80 what will become the lines of adhesive 54 bonding the lower edges 52 of closure flaps 50 to the rear walls 26 of bag 20; (3) an adhesive applicator 98, also supplied from reservoir 96, for applying to release liner 92 running, longitudinally extending lines of adhesive corresponding to, and later severed into, those identified by reference characters 58 and 60 in FIGS. 1–4; and (4) an unwind stand 100 for a strip of stock 92 later divided into segments to form cover strips 64.

Rolls collectively identified by reference character 104: (1) position the folded bag wall forming sheet 80 relative to the adhesive applicators 94 and 98; (2) then bring release tape stock 92 into contact with closure stock 102; and (3) bring the closure/cover strip assemblage 105 into contact with folded sheet 80.

The resulting bag assemblage 106 proceeds to a set of dancer rolls collectively identified by reference character 107. These convert the theretofore continuous motion of the component forming sheets, strips and assemblages into an intermittent—or stop-and-go—movement of the assemblage 106 reaching the dancer rolls.

By virtue of dancer rolls 107, the assemblage 106 is halted at uniform intervals at a pouch sealer 108 which the assemblage reaches through cooperating rolls 110. Pouch sealer 108 heat forms a side pouch seal (not shown) which is divided simultaneously into the right-hand edge seam 30 of one bag 20 and the left-hand edge seam 28 of the next bag by bonding together what will become the front and back walls 22 and 26 of bags 20 together along a line extending transversely across assemblage 106.

The bag assemblage 106 indexes to a cooling station 112 then to a guillotine-cutting station 114 which severs the assemblage 106 in the transverse direction into the individual bags 20. Bags 20 drop onto platform 116.

The invention may be embodied in many forms without departing from the spirit or essential characteristics of the invention. The present embodiments are therefore to be considered in all respects as illustrative and not restrictive, the scope of the invention being indicated by the appended claims rather than by the foregoing description and the appended drawing; and all changes which come within the meaning and range of equivalency of the claims are therefore intended to be embraced therein.

What is claimed is:

1. A self-sealing, fluidtight bag having a bottom margin, side edges and an upper end, said bag comprising:

a main body component fabricated of a flexible, impervious sheet material, said main body component having front and back walls and bottom and side margins and outer sides which are integrated along said bottom and side margins to define a compartment open at the upper end of the bag, said front and back walls having upper edges which both coincide with the upper end of the bag;

a closure which extends from one side edge of the bag to the other, is integrated at a bottom margin thereof with one of said walls on the outer side thereof, and is displaceable over the upper end of the bag and into sealing engagement with the outer surface of the other wall, said bag having at least one line of adhesive extending from one side edge of the bag to the other side edge thereof for sealing said closure to said other of said walls coincident with its being brought into sealing engagement with said other wall, said line of adhesive also sealing said closure to said one wall when said closure is brought into sealing engagement with the other side wall to thereby promote the formation of a liquidtight seal at the upper end of the bag;

the front and back walls of the bag being integrated by seams which extend continuously from the bottom margin of the bag to the upper end thereof at both of the side edges of the bag; and said seams so increasing in width over a span which is: (a) between the upper end of said bag and a level spaced downwardly from that end, and (b) overlaid by said line of adhesive as said closure is brought into sealing engagement with said other bag wall as to, (c) provide fluidtight seals at the upper end of the bag and at the side margins thereof between: (d) the front and back walls of the bag and (e) the closure and said other wall of the bag.

2. A fluidtight bag as defined in claim 1 which has means comprising said closure and said other wall for making evident separation of the closure from said other wall and subsequent resealing of said closure to that wall.

3. A fluidtight bag as defined in claim 2 wherein separation of said closure from said other wall will leave visually observable adhesive behind and distort at least one of the main body component and the closure and thereby make it at least very difficult to reseal the closure to said other wall without the separation of the closure from said other wall and the reattachment of the closure to said other wall being made evident.

4. A fluidtight bag as defined in claim 3 in which the adhesive making up the line is a pressure-sensitive adhesive.

5. A fluidtight bag as defined in claim 1 in which the line of adhesive constitutes a band which is wide enough to contact both walls of the bag when the closure is displaced into sealing engagement with said other wall, thereby completely enclosing the upper end of the bag with adhesive and promoting the liquidtightness of the seal between the back and front walls of the bag at the upper end thereof when that end is sealed.

6. A fluidtight bag as defined in claim 1 in which facing edges of the seams integrating the front and back walls of the bag angle inwardly over the span between said downwardly spaced level and the upper end of the bag.

7. A liquidtight bag as defined in claim 1 in which the main body component and the closure are separate components.

* * * * *